United States Patent [19]

Reeves

[11] Patent Number: 4,615,142

[45] Date of Patent: Oct. 7, 1986

[54] BURGLAR BARS

[76] Inventor: Irvin H. Reeves, 6158 Willers Way, Houston, Tex. 77057

[21] Appl. No.: 641,279

[22] Filed: Aug. 16, 1984

Related U.S. Application Data

[63] Continuation-in-part of Ser. No. 428,535, Sep. 30, 1982.

[51] Int. Cl.[4] ..... E06B 3/68

[52] U.S. Cl. ..... 49/55; 49/56

[58] Field of Search ..... 49/55, 56, 57

[56] References Cited

U.S. PATENT DOCUMENTS

| | | | |
|---|---|---|---|
| 1,873,229 | 8/1932 | Van Dresser | 49/55 |
| 2,043,835 | 6/1936 | McGuinness . | |
| 2,726,427 | 12/1955 | Kopf . | |
| 2,866,238 | 12/1958 | Lamb . | |
| 3,738,062 | 6/1973 | Ughi | 49/55 |
| 3,942,576 | 3/1976 | Rickard | 49/55 |
| 4,074,388 | 2/1978 | McCabe . | |
| 4,121,378 | 10/1978 | Wahl | 49/55 |
| 4,149,342 | 4/1979 | Bowers | 49/55 |
| 4,162,590 | 7/1979 | Earley | 49/55 |
| 4,325,203 | 4/1982 | Wicks | 49/57 |
| 4,400,911 | 8/1983 | Bell et al. | 49/55 |
| 4,475,309 | 10/1984 | Porter | 49/55 |

*Primary Examiner*—Kenneth Downey

*Attorney, Agent, or Firm*—Arnold, White & Durkee

[57] ABSTRACT

A burglar bar apparatus and method of assembly, for safety and security, suitable for installation in apertures of buildings is disclosed. The burglar bar apparatus comprises a totally unwelded structure with primary components being a gate member having cross rods and lateral rods, mounts for attaching the gate member to the aperture, and a locking mechanism to secure the gate in the aperture. The method for assembling the burglar bar device consists of cutting appropriate lengths of rods into a grid gate that restricts the movement of the individual rods, mounting the grid gate in the aperture, and locking the grid gate for preventing unauthorized ingression or egression.

6 Claims, 5 Drawing Figures

Fig. 4
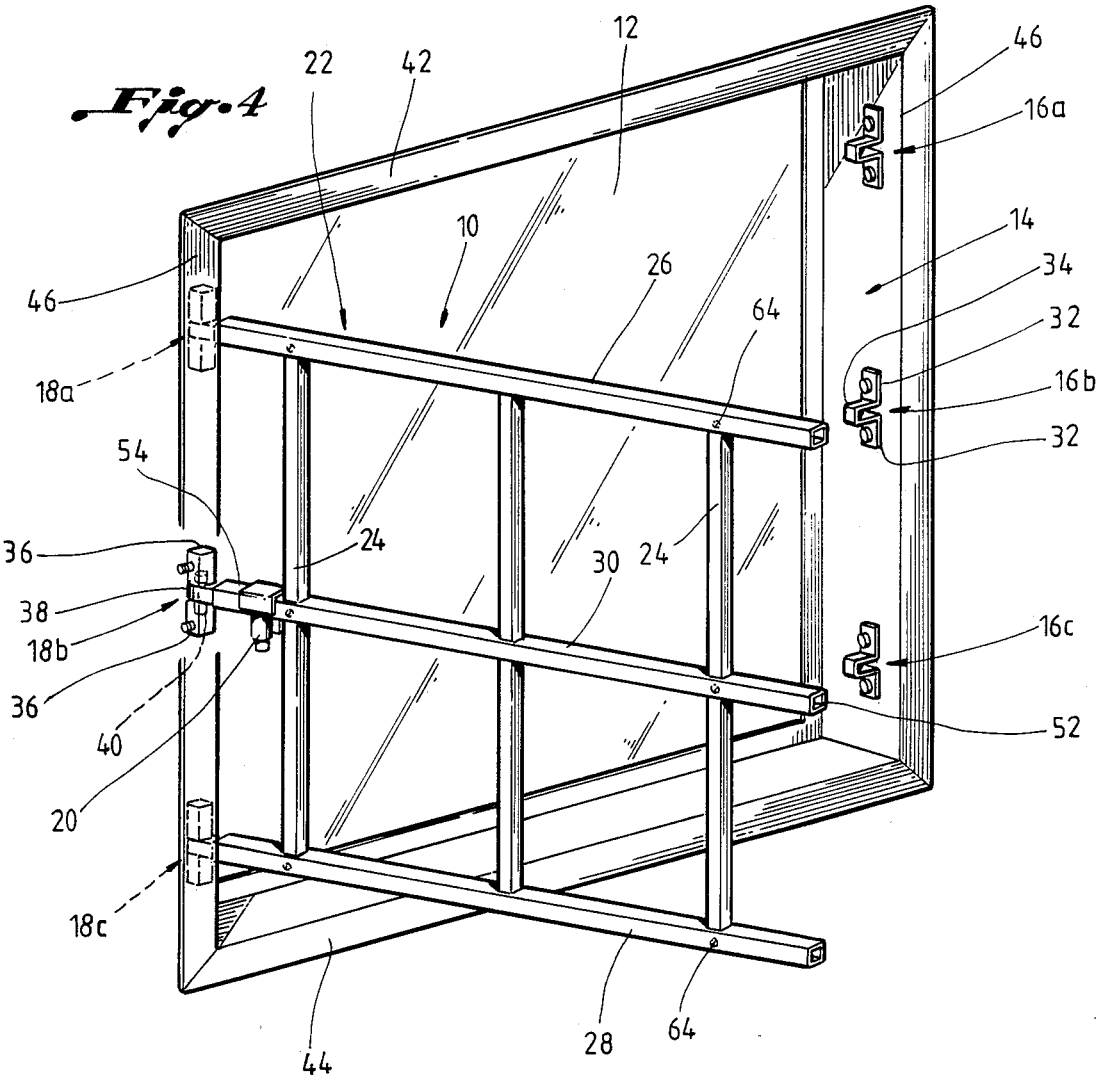
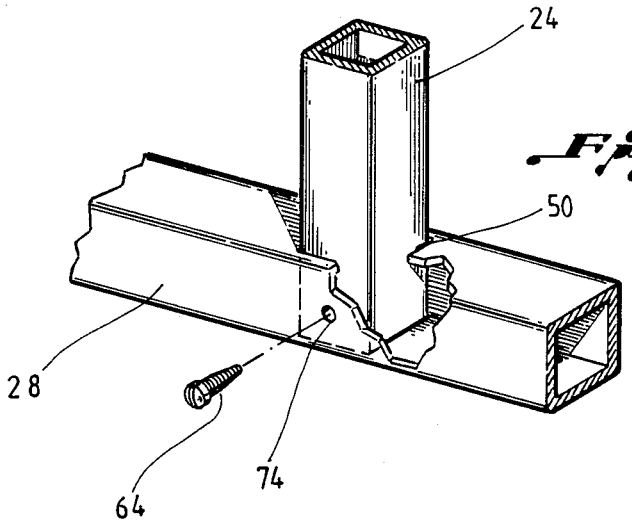
Fig. 5

BURGLAR BARS

CROSS REFERENCE TO RELATED APPLICATION

This is a continuation-in-part application of copending application Ser. No. 428,535, filed Sept. 30, 1982.

BACKGROUND OF THE INVENTION

The present invention relates generally to security devices and specifically to a burglar bar apparatus and method assembly suitable for installation in apertures of buildings and homes.

It is well known to prevent unauthorized ingress and egress through an opening in a building to rigidly mount a bar or bars across the aperture. The arrangement of the bars may take any one of several known forms. In the early art, the bars were cut to lengths longer than the dimensions of the aperture to be secured. The bars were then fastened to the aperture structure to form a rigid grid.

More recently, burglar bars have been premanufactured to be used in apertures of specific sizes. Such burglar bar devices consist of a grid assembly slightly smaller than the size of the aperture to be secured and a mounting mechanism for securing the grid in the aperture. Although they display some utility, these burglar bar devices are not adaptable to apertures having an unusual shape or exceedingly large or small size.

The burglar bar devices of the prior art require welding to provide structural integrity. The necessity of welding, prior to utilization, greatly restricts the versatility of the former devices. Pre-manufactured devices that have been welded are bulky, unmanageable and heavy. Transportation and installation are exceedingly difficult. If parts are painted prior to welding, the paint is damaged and repainting is required. Devices welded to provide structural integrity can be difficult to remove for window maintenance or cleaning.

More recently, burglar bar devices have been manufactured that are adjustable in a lateral direction. Such devices enhance the number of apertures in which the device can be used. However, some adjustable burglar bar devices demonstrate compromised structural integrity compared to devices which are custom constructed and installed for each individual window. In some instances, the adjustable devices are significantly more expensive than custom constructed and installed devices.

There is thus a need for a burglar bar apparatus which is adaptable to mounting in building apertures of varying sizes, which, at the same time, provides superior structural integrity, which is readily assembled or installed in any building aperture, and which is inexpensive.

Recognizing the need for an improved method and apparatus for securing the apertures of buildings, it is, therefore, a general object of the present invention to provide a novel burglar bar method and apparatus which minimizes or reduces the problems of the type previously noted.

It is, therefore, a feature of the present invention to provide a burglar bar apparatus and method for installation in apertures of buildings, preferably on the inside of the structure.

It is a more particular feature of the present invention to provide a burglar bar method and apparatus having components requiring no welding.

Another feature of the present invention is to provide a burglar bar apparatus adjustable to accommodate varying sizes of windows or doors. The present invention can be adapted and assembled for an aperture of any size or shape.

Yet another feature of the present invention is to provide a burglar bar apparatus which can be locked. When locked, the burglar bar device prevents the entrance or egress of individuals or articles through the aperture.

Still another feature of the present invention is to provide a burglar bar apparatus which may be easily swung out of its usual locked position in the event of, say, an emergency such as fire or routine cleaning and maintenance on windows and the like. This feature readily allows entrance or egress of individuals or articles under both emergency and routine conditions.

Yet still another feature of the present invention is to provide a burglar bar apparatus which, upon unlocking will not readily disengage from or fall out of the aperture to be secured.

A further feature is to provide a burglar bar apparatus and method which, when desired, may be completely disengaged from and, thereafter, replaced in the aperture of the building. The complete disengagement and replacement of the burglar bar device may be done without tools or substantial disassembly of the structure.

Yet further the present invention provides a burglar bar method and apparatus requiring only one locking-/unlocking mechanism and provides for easily disengaging and reengaging the apparatus from the aperture of the building.

Still further the present invention provides a burglar bar method and apparatus having a grid which provides for telescoping cooperation with fixed mounts along one side of the grid.

Also, the telescoping mounts to the present invention are of a length such that the transverse movement of the grid permits the grid to slide free of telescoping mounts on one side of the grid. The other side of the grid remains engaged with corresponding pivotal telescoping mounts, thereby allowing the grid to swing out of the plane of the aperture.

Still another feature of the present invention is to provide a burglar bar method and apparatus having a grid comprised of lateral rods and cross rods engaged in a manner that when the grid is secured in the aperture of a building, all the rods are restricted from substantially any movement within the plane of the aperture. This configuration of the lateral rods and cross rods substantially eliminates the necessity of providing additional means for securing one rod to another rod to restrict the motion of the rods.

Yet still another feature of the present invention is to provide a novel burglar bar apparatus which may be assembled, without welding, by mechanically coupling lateral and cross rods to form a grid mountable for securing an aperture of a building from ingression or egression.

Yet still further the present invention provides a method of securing from ingression or egression an aperture of virtually any size. Lateral rods and cross rods of standard lengths are cut to the appropriate dimensions, assembled, and installed in the aperture of the building without requiring welding.

Additional objects and advantages of the invention will be set forth in part in the description which follows, and in part will become apparent from the description, or may be learned by practice of the invention. The objects, features and advantages of the invention may be realized by means of the combinations and steps particularly pointed out in the appended claims.

SUMMARY OF THE INVENTION

To achieve the foregoing objects, features and advantages, and in accordance with the purposes of the invention as embodied and broadly described herein, a burglar bar apparatus is provided for safety and security which is mountable in a window or door aperture without requiring welding. The burglar bar apparatus of the present invention comprises a grid-like gate, means for mounting the gate to the aperture, a hinge associated with the mounting means and the gate for displacing the gate from the aperture, and means for locking the gate when the gate is in the aperture for preventing passage therethrough.

It is preferable that the gate comprise a plurality of laterally extending rods intersected by a plurality of cross rods. The cross rods preferably are smaller in cross-sectional area than the lateral rods. Therefore, the cross rods may be held in place by passing through or into the lateral rods as set forth more fully below.

Preferably, the means for mounting the gate comprises a plurality of pairs of opposing mounting brackets, each pair associated with a lateral rod. Both mounting brackets of each pair are secured to the aperture structure. The first of the two opposing brackets comprises a flange portion and a post portion. The flange portion is secured to the aperture structure and the post portion is adapted to telescope into one end of an associated lateral rod comprising the grid-like gate. The opposing mounting bracket comprises a flange portion, a pivotal post portion and a hinge. The flange portion is affixed to the aperture structure, and the post portion pivots about the hinge which is mechanically associated with the flange portion. The pivotal post portion is adapted to telescope into the opposite end of the associated lateral rod engaged with the first bracket. The mounting brackets preferably are secured to the aperture structure by non-reversible screws.

Also preferably, a means for locking the gate is provided comprising a locking member and a passage. The passage is defined by an aperture in an end of an associated lateral rod and an aperture in the pivotal post portion of an associated mounting bracket. When the apertures are moved into registry, the locking member may be introduced into the passage, thereby preventing relative movement between the lateral rod and the telescoping pivotal post portion.

Of independent significance, the invention comprises a method for securing an aperture in a building by a series of steps. First a grid is assembled, the grid being mountable in a window or door aperture. The grid is fashioned from two sets of rods, a first set of rods being of slightly larger cross-sectional area than a second set of rods. The assembly method comprises cutting one or more of the larger rods slightly shorter than the width of the interior dimension of the aperture, cutting one or more of the smaller rods shorter than the height of the interior dimension of the aperture, forming recesses or passages in the larger rods to allow the smaller rods to be engaged therein to form a grid, mounting the grid in the aperture, and locking the grid in the aperture for preventing the unauthorized ingression or egression therefrom.

In preferred form, the method of the present invention includes the steps of inserting a pivotal post into a first end of one of the larger rods, pivoting the grid on the pivotal post into the plane of the aperture, telescoping the grid on the pivotal post away from the engaged side of the aperture, engaging the opposite end of the rod with a stationary post associated with the opposite side of the aperture, and further sliding the grid off the pivotal post and onto the stationary post.

Preferably, the method comprises locking the grid to a mounting post. A locking mechanism may be activated by inserting a locking shaft or member into a passage in the grid and mounting post. The passage is preferably defined by an aperture in a lateral rod which has been aligned in registration with an aperture in the pivotal post.

BRIEF DESCRIPTION OF THE DRAWINGS

The accompanying drawings, which are incorporated into and constitute a part of the specification, illustrate a preferred embodiment of the invention and, together with the general description of the invention given above and the detailed description of the preferred embodiment given below, serve to explain the principles of the invention.

FIG. 4 is a perspective view of the burglar bar apparatus of FIG. 1 in an unlocked and open position; and FIG. 5 is a detailed partial-sectional view of the junction of a cross bar in an exterior lateral rod.

The above general description and the following detailed description are merely illustrative of the generic invention, and additional modes, advantages, and particulars of this invention will be readily suggested to those skilled in the art by the following detailed description.

DESCRIPTION OF THE PREFERRED EMBODIMENTS

Reference will now be made in detail to a presently preferred embodiment of the invention as illustrated in the accompanying drawings.

Figure 1:
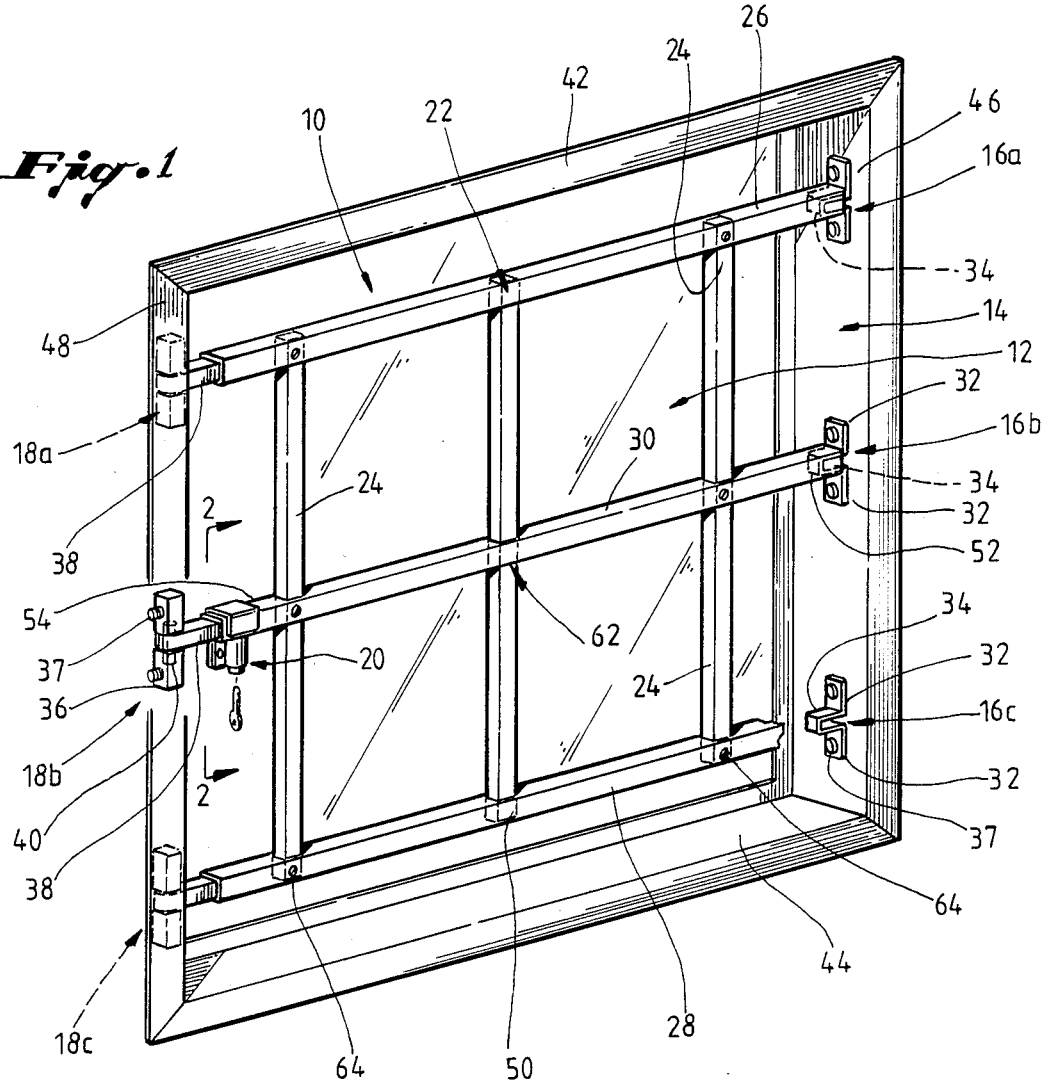
FIG. 1 is a perspective view of a burglar bar apparatus of the present invention in a locked and secured position.

In FIG. 1 there is shown a perspective view of the burglar bar apparatus 10 in a locked and secured position. The burglar bar apparatus 10 is shown in the plane of an aperture 12 which could be a window of a home or building. The burglar bar apparatus 10 is attached to the aperture structure or frame 14 by a set of firts mounting brackets 16*a*, 16*b*, and 16*c* and a set of second mounting brackets 18*a*, 18*b*, and 18*c*. The burglar bar apparatus 10 is fixedly secured in the aperture 12 by a locking mechanism 20. Burglar bar apparatus 10 comprises a gate member 22, the locking mechanism 20, and the mounting brackets 16*a*, 16*b*, 16*c* and 18*a*, 18*b*, 18*c*.

As shown in FIG. 1, gate member 22 comprises cross rods 24, exterior lateral rods 26 and 28, and an interior lateral rod 30. The exterior lateral rods 26 and 28 and the interior lateral rod 30 preferably are made of square steel tubing. The cross rods 24 are made of square steel tubing with a smaller cross-sectional area than the lateral rods 26, 28 and 30.

The gate member 22 is secured in aperture 12 by first mounting brackets 16*a*, 16*b*, 16*c* and second mounting brackets 18*a*, 18*b*, 18*c*, a pair of brackets associated with each lateral rod. The mounting brackets preferably are secured to aperture 12 by non-reversible screws 37.

First mounting brackets 16*a*, 16*b*, 16*c* each comprises a flat bar formed into a first flange portion 32 and a first post portion 34. The first flange portion 32 is preferably attached to the aperture structure or frame 14 by non-reversible screws 37. The first post portion 34 of each first mounting bracket actively engages the gate member 22.

Second mounting brackets 18*a*, 18*b*, 18*c* each comprises a second flange portion 36 made up of upper and lower sections attached to the aperture structure or frame 14 by non-reversible screws, a bar-like second post portion 38, and a hinge pin 40. The ends of hinge pin 40 reside in recesses in the upper and lower sections of flange portion 36 and the hinge passes through an aperture in post portion 38. Second post portion 38 pivots on hinge pin 40 and can be displaced through a horizontal arc perpendicular to the structure or frame 14 to which second flange portion 36 is attached. Each second post portion 38 engages the gate member 22. The gate member is operatively associated with each second post portion 38 so that the second post portions 38 act to pivot gate member 22 into and out of the plane of aperture 12.

Gate member 22 comprises cross rods 24, exterior lateral rods 26 and 28, and interior lateral rod 30. Exterior lateral rods 26 and 28 are aligned parallel to jamb 42 and jamb 44. Exterior lateral rods 26 and 28 are precut to be positioned within the confines of jamb 46 and jamb 48 of the aperture structure or frame 14. Exterior lateral rods 26 and 28 have therein corresponding spaced apart closed-ended recesses 50.

Interior lateral rod 30 is precut to be positioned within jamb 46 and jamb 48 of the aperture structure or frame 14. The interior lateral rod 30 has operatively spaced apart open-ended recesses 62 corresponding with the closed-ended recesses 50 of exterior lateral rods 26 and 28.

Each lateral rod 26, 28, 30 has a first end 52 and a second end 54. First end 52 is adapted to slidingly receive therein an associated first post portion 34, and second end 54 is adapted to slidingly receive therein an associated second post portion 38.

The gate member 22 is assembled by passing cross rods 24 through the open-ended recesses 62 of interior lateral rod 30 and inserting the extremities of cross rods 24 into the closed-ended recesses 50 of exterior lateral rods 26 and 28. To hold the lateral rods and cross rods in position before placing the gate in the aperture and also when the gate is pivoted out of the aperture, the gate member 22 is held rigid by self-tapping screws 64 passing through lateral rods 26, 28, 30 and engaging some of the cross rods 24. Any number of screws may be used depending upon how much rigidity is desired. However, these screws are not necessary to the integrity of the gate once it is mounted in place in the aperture.

Gate member 22 initially engages second post portions 38 at second ends 54. During assembly or removal of the burglar bars 20, first post portions 34 slide into and out of first ends 52 as gate member 22 is moved from one side of aperture 12 to the other side of aperture 12.

FIG. 1 shows the gate member 22 operatively engaged with first mounting brackets 16*a*, 16*b*, 16*c* and second mounting brackets 18*a*, 18*b*, 18*c*. The gate member 22 can be slid onto first post portions 34 by manually urging the gate member laterally in the appropriate direction. It will of course be appreciated that first post portions 34 telescope out of first ends 52 of the lateral rods. The second post portions 38 are of an appropriate length so that upon fully sliding gate member 22 toward first mounting brackets 16*a*, 16*b*, 16*c*, the gate member 22 will not become disengaged from second mounting brackets 18*a*, 18*b*, 18*c*. However, sliding gate member 22 toward the second mounting brackets allows first post portions 34 to pass from within first ends 52. Gate member 22 can then be swung out of the plane of aperture 12 as shown in FIG. 4.

Figure 2:
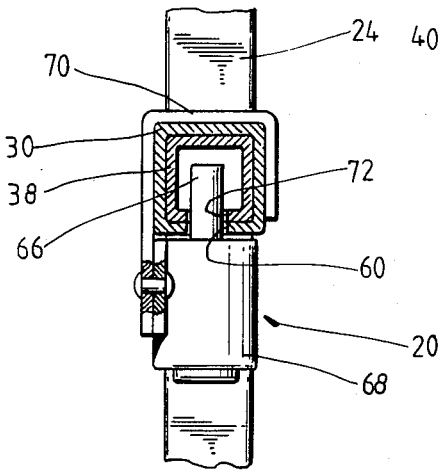
FIG. 2 is a cross-sectional view taken along the section line 2—2 in FIG. 1 showing a sectional view of a locking mechanism.

FIG. 2 shows a partial-sectional view of the locking mechanism 20 mounted on interior lateral rod 30. The locking mechanism 20 includes a piston 66, lock casing 68, and lock support 70. FIG. 2 depicts the locking mechanism 20 in a locked mode. The lock casing 68 upon engagement causes the piston 66 to pass through an aperture 60 in interior lateral rod 30 and an aperture 72 in second post portion 38. Lock casing 68 is affixed to the interior lateral rod 30 of gate member 22 by a lock support 70 which passes around the interior lateral rod 30. When the locking mechanism 20 is activated, as shown in FIG. 2, the piston 66 engages the interior lateral rod 30 and the second post portion 38. This prevents any significant relative movement, for example, telescoping movement. Gate member 22 is thus secured in the plane of aperture 12. Gate member 22 is restricted from sliding either toward first mounting brackets 16*a*, 16*b*, 16*c* or toward second mounting brackets 18*a*, 18*b*, 18*c*.

Figure 3:
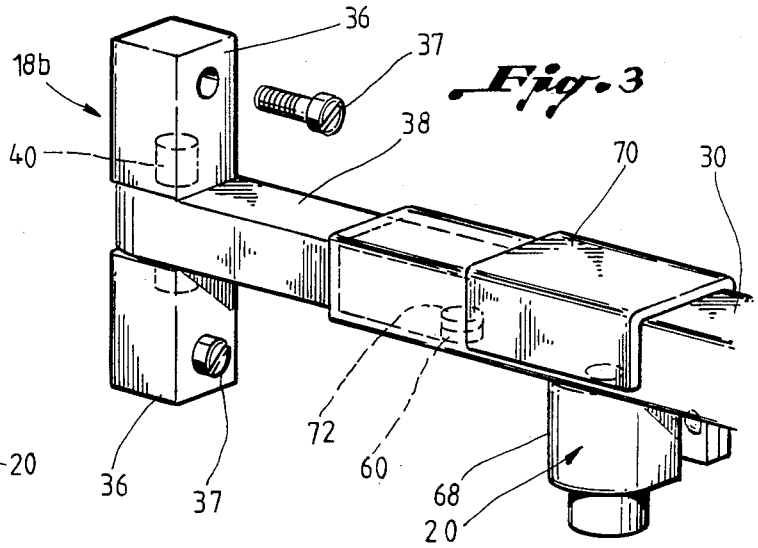
FIG. 3 is a perspective, partial-sectional view of the locking mechanism illustrated in FIGS. 1 and 2.

FIG. 3 shows the locking mechanism 20 in an unlocked mode. The piston 66 is withdrawn from the aperture 72 in the second post portion 38 and the aperture 60 in the interior lateral rod 30 and is within the lock casing 68. In the unlocked mode, as shown in FIG. 3, lateral rods 26, 28, 30 (as part of gate member 22) are readily movable as second post portions 38 slide into and out of second ends 54 of the lateral rods.

With the gate member 22 engaged on post portions 34, 38 and locking mechanism 20 locked, cross rods 24 and lateral rods 26, 28, 30 are held in position. The lateral rods cannot be moved because they are engaged on the post portions, and the cross rods cannot be moved because they are engaged in closed-ended recesses 50 and open-ended recesses 62.

FIG. 4 shows burglar bar 10 with gate member 22 in an open position displaced from the plane of aperture 12. The locking mechanism 20 is shown in an unlocked mode.

The burglar bar 10 may be moved from the locked, secured position, as shown in FIG. 1, to the unlocked, open position as shown in FIG. 4. This is accomplished by first disengaging the locking mechanism 20. When the locking mechanism 20 is in an unlocked mode, the piston 66 is disengaged from second post portion 38 and is held within the lock casing 68. This facilitates the sliding of gate member 22 toward second mounting brackets 18*a*, 18*b*, 18*c* along the second post portions 38 and first post portions 34. When the gate member 22 has been displaced an appropriate distance, first post portions 34 will disengate from first ends 52 of the lateral rods 26, 28, 30. This allows the gate member 22 which now has second post portions 38 fully engaged in ends 54, to be pivoted about hinge pins 40. The gate member 22 may swing free from the plane of aperture 12 as shown in FIG. 4.

By way of example, FIG. 5 illustrates the junction of the cross rods 24 with exterior lateral rod 28. The cross rod 24 is inserted in the closed-ended recess 50 in exterior lateral rod 28. A self-tapping screw 64 is screwed into lateral rod 28, creating an aperture 74 and causing screw 64 to engage cross rod 24. The cross rod 24 is thus fixedly coupled with exterior lateral rod 28 for installing the gate member 22 in aperture 12.

The present invention can be assembled and utilized without welding. Lateral rods 26, 28, 30 are precut to be positioned across aperture 12. The cross rods 24 are precut to be positioned vertically across the height of aperture 12. The open-ended recesses 62 are closed-ended recesses 50 are precut in the interior lateral rod 30 and exterior lateral rods 26 and 28, respectively. The cross rods 24 are inserted through the open ended recesses 62. The extremities of the cross rods 24 are inserted into the closed-ended recesses 50 in exterior lateral rods 26 and 28. Self-tapping screws 64 are therein engaged to secure cross rods 24 to the lateral rods.

The locking mechanism 20 is engaged with the interior lateral rod 30 of the gate member 22 and the second post portion 38. The locking mechanism 20 is activated when aperture 60 in the interior lateral rod 30 is aligned with aperture 72 in the second post portion 38 to allow piston 66 to pass therethrough. The aperture 72 in the second post portion 38 and the aperture 60 in interior lateral rod 30 are brought into registry and secured into position by piston 66 so that first post portions 34 stay inserted in first ends 52 of the lateral rods.

The locking mechanism 20 for burglar bar 10 is not restricted to that shown in the drawings. It is equally appropriate and advantageous to pass a securing member of a padlock through the apertures 60 and 72 in interior lateral rod 30 and second post portion 38, respectively. An device can be utilized to pass through apertures 60 and 72 for securing the relative motion between interior lateral rod 30 and second post portion 38. Restricting the movement between interior lateral rod 30 and second post portion 38 while first end 52 of interior lateral rod 30 engages first post portion 34 causes gate member 22 to be substantially affixed in aperture 12.

Additional advantages and modifications will readily occur to those skilled in the art. The invention in its broaded aspects is therefore not limited to the specific details, representative method and apparatus described herein. Accordingly, departures may be made from the detail without departing from the spirit or scope of the disclosed general inventive concept.

What is claimed is:

1. A burglar bar apparatus mountable in the frame of a building aperture comprising:

a. a plurality of vertically spaced, laterally disposed lateral rods having corresponding first ends and opposite second ends;

b. a pair of mounting brackets for each lateral rod adapted to be mounted on laterally opposite jambs of the building aperture at the level of the respective lateral rod, a first bracket of each pair engaging the first end of its respective lateral rod, and a second bracket of each pair engaging the second end of its respective lateral rod, each first mounting bracket comprising a first flange portion attached to the aperture jamb and a laterally disposed first post portion extending from the first flange portion and sized to be received in the first end of its respective lateral rod, each second mounting bracket comprising a second flange portion attached to the opposite aperture jamb and a laterally disposed second post portion extending from the second flange portion and sized to be received in the second end of its respective lateral rod; and c. a plurality of vertically disposed cross rods laterally spaced along the lateral rods to interconnect the lateral rods, each cross rod engaged without welding at its upper end to the uppermost lateral rod and at its lower end to the lowermost lateral rod to form a grid of the lateral rods and cross rods, the lateral rods being larger in cross section than the cross rods, each cross rod extending through a respective open-ended recess in each lateral rod intermediate the uppermost and lowermost lateral rods, the upper and lower ends of each cross rod being rigidly recessed within closed-ended recesses in the uppermost and lowermost lateral rods, respectively.

2. The burglar bar apparatus of claim 1, wherein:

a. the second post portion is pivotally mounted on a hinge on the second flange portion of each second mounting bracket to enable the second post portions to swing about a vertical line extending through the hinge, the second post portions being slidable within the second end of their respective lateral rods;

b. the first post portions are slidable within the first end of their respective lateral rods;

c. each lateral rod and first post portion is sized in length to enable the grid to slide laterally between a first aperture securing position in which at least a part of each first post portion is engaged within the first end of its respective lateral rod and a second position in which each first post portion is entirely disengaged from the first end of the respective lateral rod, the grid being pivotable out of the aperture on the hinge when the grid is in the second position; and d. a lock associated with at least one lateral rod operable to lock the respective lateral rod to one of its respective mounting brackets when the grid is in the first aperture securing position.

3. The burglar bar apparatus of claim 2 wherein the lock comprises:

a. a transverse aperture in one respective second post portion;

b. a corresponding transverse aperture in the second end of the respective lateral rod; and c. a piston operatively associated with the second post portion and the second end of the respective lateral rod, the second post portion being inserted into the second end of the respective lateral rod for creating a passage upon bringing into registry the second post portion aperture and the second end aperture, the piston being insertable in the passage for restricting relative movement between the second post portion and the respective lateral rod.

4. The burglar bar apparatus of claim 3, wherein the cross rods and lateral rods are connected by screws passing into the lateral rods and engaging the cross rods at a plurality of the intersections of the cross rods and lateral rods.

5. A burglar bar apparatus mountable to a frame of a building aperture comprising:

a. a gate member which comprises a plurality of vertically spaced lateral rods, each lateral rod having a first swinging end and a second pivoting end, the uppermost lateral rod having a plurality of downward opening spaced apart closed-ended recesses, the lowermost lateral rod having a corresponding plurality of upward opening spaced apart closed-ended recesses, the lateral rods intermediate the uppermost and lowermost lateral rods each having a corresponding plurality of open-ended recesses, the second pivoting end having a transverse aperture therein, a corresponding plurality of laterally spaced and vertically disposed cross rods, the upper and lower ends of the cross rods being inserted in the closed-ended recesses in the uppermost and lowermost lateral rods, respectively, the cross rods being inserted through the open-ended recesses in the intermediate lateral rods;

b. a plurality of first mounts, each first mount being associated with a lateral rod, each first mount comprising a first flange portion and a laterally disposed first post portion, the first flange portion being affixed to the side of the aperture frame, the first post portion being insertable into the first swinging end of the associated lateral rod;

c. a plurality of second mounts, each second mount being associated with a lateral rod, each second mount comprising a second flange portion affixed to the opposite side of the aperture frame and a second post portion pivotally connected to the second flange portion, the second post portion having a transverse aperture therein, the second post portion being insertable into the second pivoting end of the associated lateral rod for pivoting the gate member into and out of the aperture; and d. a piston operatively associated with at least one of the second post portions and the second pivoting end of the associated lateral rod, the second post portion being inserted into the second pivoting end of the lateral rod for forming a passage upon bringing into registry the aperture in the second post portion and the aperture in the second pivoting end of the lateral rod, the piston being insertable in the passage for restricting sliding relative movement between the second post portion and the lateral rod.

6. A burglar bar apparatus mountable in the frame of a building aperture comprising:

a. a plurality of vertically spaced, laterally disposed lateral rods having corresponding first ends and opposite second ends;

b. a pair of mounting brackets for each lateral rod adapted to be mounted on laterally opposite jambs of the building aperture at the level of the respective lateral rod, a first bracket of each pair engaging the first end of its respective lateral rod, and a second bracket of each pair engaging the second end of its respective lateral rod, each first mounting bracket comprising a first flange portion attached to the aperture jamb and a laterally disposed first post portion extending from the first flange portion and sized to be received in the first end of its respective lateral rod, each second mounting bracket comprising a second flange portion attached to the opposite aperture jamb and a laterally disposed second post portion extending from the second flange portion and sized to be received in the second end of its respective lateral rod, the second post portion being pivotally mounted on a hinge on the second flange portion of each second mounting bracket to enable the second post portions to swing about a vertical line extending through the hinge, the second post portions being slidable within the second end of their respective lateral rods, the first post portions being slidable within the first end of their respective lateral rods;

c. a plurality of vertically disposed cross rods laterally spaced along the lateral rods to interconnect the lateral rods, each cross rod engaged without welding at its upper end to the uppermost lateral rod and at its lower end to the lowermost lateral rod to form a grid of the lateral rods and cross rods, each lateral rod and first post portion being sized in length to enable the grid to slide laterally between a first aperture securing position in which at least a part of each first post portion is engaged within the first end of its respective lateral rod and a second position in which each first post portion is entirely disengaged from the first end of the respective lateral rod, the grid being pivotable out of the aperture on the hinge when the grid is in the second position; and d. a lock associated with at least one lateral rod operable to lock the respective lateral rod to one of its respective mounting brackets when the grid is in the first aperture securing position.

* * * * *